US005543258A

United States Patent [19]

Dan et al.

[11] Patent Number: 5,543,258

[45] Date of Patent: Aug. 6, 1996

[54] ORIGINAL FORME FOR ELECTROPHOTOGRAHIC PLANOGRAPHY

[75] Inventors: Shigeyuki Dan; Takao Nakayama; Hiroshi Nishizawa; Hidefumi Sera, all of Shizuoka, Japan

[73] Assignee: Fuji Photo Film Co., Ltd., Kanagawa, Japan

[21] Appl. No.: 263,738

[22] Filed: Jun. 22, 1994

[30] Foreign Application Priority Data

Jun. 22, 1993 [JP] Japan ..... 5-150381

[51] Int. Cl.[6] ..... G03G 5/08

[52] U.S. Cl. ..... 430/87; 430/130; 430/49

[58] Field of Search ..... 430/49, 87, 130

[56] References Cited

U.S. PATENT DOCUMENTS 3,787,209 1/1974 Jones ..... 430/87

4,673,627 6/1987 Kunichika et al. ..... 340/87

4,996,121 2/1991 Kato et al. ..... 430/87

FOREIGN PATENT DOCUMENTS 187380 7/1986 European Pat. Off. ..... 430/49

1497222 5/1969 Germany ..... 430/87

*Primary Examiner*—Christopher D. Rodee

*Attorney, Agent, or Firm*—Sughrue, Mion, Zinn, Macpeak & Seas

[57] ABSTRACT

An original form for electrophotographic planography includes a paper support having thereon a photoconductive layer including a photoconductive material including at least zinc oxide and a resin binder, the exposure percentage of the zinc oxide on a surface of the photoconductive layer being in the range of from 2.1 to 5%.

3 Claims, No Drawings

ORIGINAL FORME FOR ELECTROPHOTOGRAHIC PLANOGRAPHY

FIELD OF THE INVENTION

The present invention relates to an original forme for electrophotographic planography, and more particularly to an original forme for planography improved in resistance to printing scumming and scratching.

BACKGROUND OF THE INVENTION

Processes for preparing printing formes for planography by electrophotography have been known, and the printing formes are usually obtained according to the following method: First, photoconductive layers are uniformly charged, subjected to imagewise exposure, and developed through a wet process or a dry process to obtain toner images, followed by fixing them. Non-image portions are then made hydrophilic by desensitizing treatment to obtain the printing formes for planography. In the printing formes for planography, scumming on the non-image portions (referred to as "background scumming") must be avoided. However, in the printing formes for planography thus obtained, background scumming development has not actually been avoided completely. Particularly, the use of an exhausted desensitizing solution employed repeatedly, color inks in printing, and neutral paper as printed paper has frequently resulted in development of background scumming.

It is effective against such background scumming to repeat the desensitizing treatment twice or more. However, this method increases steps to lower operation efficiency, and cannot be adopted in automatic printing machines which are recently widely used where etching processors for the desensitizing treatment are integrated into printers. Furthermore, this method also has a problem of impairing inking property on image portions.

As other methods to prevent background scumming, for example, JP-B-50-31011 (the term "JP-B" as used herein means an "examined published Japanese patent publication"), JP-A-54-20735 (the term "JP-A" as used herein means an "unexamined published Japanese patent application") and JP-A-58-68046 disclose that improvements in resin binders used for photoconductive layers are effective against background scumming. However, actual detailed examination of the binders shows that the effect of preventing scumming has not been fully satisfactory.

SUMMARY OF THE INVENTION

An object of the present invention is to solve the above-described prior art problems and to provide printing formes for electrophotographic planography which develop little background scumming even by a single cycle of desensitizing treatment, and further even by the use of color inks, neutral paper, and an exhausted desensitizing solution.

Other objects and effects of the present invention will be apparent from the following description.

As a result of intensive studies, the present inventors have discovered that the above-mentioned objects of the present invention can be attained by an original forme for electrophotographic planography, in which the exposure percentage of zinc oxide on the surface of a photoconductive layer, which comprises a photoconductive material including at least zinc oxide and a resin binder, is in the range of from 2.1 to 5%.

The present invention relates to an original forme for electrophotographic planography comprising a paper support having thereon a photoconductive layer comprising a photoconductive material including at least zinc oxide and a resin binder, the exposure percentage of the zinc oxide on a surface of the photoconductive layer being in the range of from 2.1 to 5%.

DETAILED DESCRIPTION OF THE INVENTION

The photoconductive layer on the original forme for electrophotographic planography according to the present invention contains a photoconductive material and a resin binder as main components, and the photoconductive material contains at least zinc oxide. Zinc oxide can be used as a mixture thereof with other photoconductive materials, such as cadmium sulfide, titanium oxide, etc. The proportions of zinc oxide and other photoconductive materials are not particularly limited as long as the exposure percentage of the zinc oxide is in the range of from 2.1 to 5%.

Examples of the resin binders include silicone resins, polystyrene, polyacrylic or polymethacrylic acid esters, polyvinyl acetate, polyvinyl chloride, polyvinyl butyral and the like which may be used singly, as copolymers or as mixtures thereof.

In such a photoconductive layer comprising the photoconductive material and the resin binder as main components, it has been found that background scumming developed on printing can be prevented, when the exposure percentage of zinc oxide on the surface of the layer is in the range of from 2.1 to 5%.

If the exposure percentage of zinc oxide is less than 2.1%, background scumming cannot be completely prevented because a desensitizing solution is difficult to penetrate into zinc oxide, which makes desensitizing treatment insufficient.

When the exposure percentage of zinc oxide is 2.1% or more, penetration of the desensitizing solution into zinc oxide is improved, which results in prevention of background scumming. Such an effect becomes particular in an automatic printing machine in which the time distance between the desensitizing treatment to the printing stage is short.

An exposure percentage of zinc oxide exceeding 5% causes the decreased fixing strength of hydrophilic materials contained in the desensitizing solution to the surface of the photoconductive layer. Accordingly, when the layer surface suffers mechanical strength, the hydrophilic materials drop out of the surface, so that a phenomenon known as so-called "scratching" is liable to occur. In particular, the scratching is liable to develop in the above-mentioned automatic printing machine, in which the printing forme is pinched and conveyed with a machine after desensitizing treatment. Therefore, an exposure percentage exceeding 5% actually makes it difficult to use the planographic printing forme.

It has been found, therefore, that the optimum range of the exposure percentage of zinc oxide wherein background scumming and scratching are difficult to develop is within the range of from 2.1 to 5%, and that satisfactory printed matters can be obtained within this range.

It is preferred in the present invention that the exposure percentage of the zinc oxide on the surface of the photoconductive layer is from 2.2 to 4.5%.

The exposure percentage of zinc oxide on the surface of the photoconductive layer of the present invention can be calculated using XPS (X-ray Photoelectron Spectroscopy). XPS which is also called ESCA (Electron Spectroscopy for Chemical Analysis) is a technique for obtaining knowledge about an electronic state and a vibrational state of atoms and molecules or a state of a solid surface by irradiating materials with a highly monochromatic X-ray such as a Kα ray of Al or Mg and measuring the kinetic energy distribution and the angular distribution of electrons emitted therefrom with an electrostatic analyzer.

The exposure percentage of zinc oxide on the surface of the photoconductive layer as used herein is determined by the following equation, using zinc photoelectron spectra of XPS:

Exposing percentage of zinc oxide (%) =

$$\frac{\text{Zinc photoelectron spectral intensity of photoconductive layer surface}}{\text{Zinc photoelectron spectral intensity of pure zinc oxide powder}} \times 100$$

Measurement of the above-mentioned zinc photoelectron spectral intensity was conducted according to a method described in *Hyomen* (Surface), Vol. 27, pp 667 (1989), edited by Hyomen Danwakai and Colloid Konwakai, Japan. Specifically, prior to the spectrum measurement of the pure zinc oxide powder used as a standard, clean surfaces were prepared through an ion etching technique. By using the ion etching technique, the spectral intensity of the zinc oxide powder used as the standard is kept constant, so that measurement precision can be significantly improved.

Various methods can be adopted for adjusting the exposure percentage of zinc oxide on the surface of the photoconductive layer to the range of from 2.1 to 5%. Examples of such methods include a method for developing brushing by drying with moisturized air after coating of the photoconductive layer, or a method for controlling the exposure percentage ratio of zinc oxide after coating and drying by a surface treatment such as glow discharge, flame treatment, plasma treatment, electron beam irradiation, and ozone treatment.

The exposure percentage of the present invention can also be obtained by lowering the amount ratio of the resin binder to the photoconductive material. Lowering the amount ratio of the resin binder may bring about a good result for background scumming, however, it makes the whole photoconductive layer brittle, impairing suitability for the printing forme.

Therefore, the weight ratio of the photoconductive material to the resin binder is preferably used within the range of from 85/15 to 82/18. If the ratio of the photoconductive material is higher than this range, the whole photoconductive layer becomes brittle, which results in a problem in physical properties in using the printing forme. A of the resin binder which is too high markedly lowers the sensitivity or uniformity of the coated surface, which substantially makes it impossible to use as the original forme.

The photoconductive layer of the original forme of the present invention may further contain known sensitizers, such as rose bengal.

As paper supports used in the present invention, those which have hitherto been used in an electrophotographic photosensitive material can be employed. Examples thereof include paper supports which is impregnated with ion-conductive materials or electron-conductive materials such as carbon, as described in U.S. Pat. No. 3,597,272 and French Patent 2,277,136, or in which they are incorporated in making paper.

A coated layer having a water resistance function (a water resistance layer) can be provided between the paper support and the photoconductive layer, and also on the back surface of the paper support. Examples of materials for the water resistance layer include polyacrylic or polymethacrylic acid esters, polyvinyl acetate, SBR, polyvinyl alcohol, casein, starch, cellulose, etc. Ion-conductive materials or inorganic metal compounds may be mixed therewith as needed.

A metal thin film such as aluminum may be contained inside the paper support, or between the paper support and the water resistance layer.

As solvents used for preparing and coating a photoconductive layer coating compositions, any solvents known in this technical field can be used. Examples thereof include benzene, toluene, xylene, isopropyl alcohol, ethyl alcohol, methyl alcohol, tetrahydrofuran and dichloromethane, and combinations thereof. Further, lower carboxylic acids such as formic acid, acetic acid, and propionic acid may also be mixed with the above-mentioned solvents.

In the present invention, the dry coated amount of the photoconductive layer is preferably from 5 to 30 $g/m^2$.

Methods hitherto known can be used for preparing a planographic printing forme from the original forme for electrophotographic planography of the present invention. Specifically, after the photoconductive layer obtained according to the present invention has been uniformly charged by a corona charging method, electrostatic latent images are formed by imagewise exposure, toner is allowed to adhere through a wet process or a dry process, followed by fixing through a technique such as heating. Non-image portions are then treated with a desensitizing solution to make them hydrophilic.

Examples of the desensitizing solutions include compositions containing ferrocyanic compounds or ferricyanic compounds as described in U.S. Pat. No. 4,116,698 and compositions containing metal complex salts as described in U.S. Pat. No. 4,282,811.

According to the present invention, no background scumming develops even when desensitizing treatment is conducted once using an exhausted desensitizing solution.

When offset printing is conducted according to ordinary methods using the planographic printing forme thus prepared according to the present invention, printed matter of no background scumming can be readily obtained. The planographic printing forme prepared according to the present invention develops little background scumming even when color inks and neutral paper are used.

The present invention will be illustrated by means of examples in more detail below. However, the invention is not construed as being limited to these examples. In the examples, all percentages and parts are by weight.

EXAMPLES 1 AND 2 AND COMPARATIVE EXAMPLES 1 AND 2

The following starting materials were mixed and dispersed with a Kady mill at a rate of 5,000 rpm for 20 minutes to obtain Dispersion 1 for a photoconductive layer.

| Dispersion 1 | |
|---|---|
| Photoconductive Zinc Oxide ("Sazex 2000", manufactured by Sakai Kagaku K.K.) | 100 parts |
| Resin Binder ("LR018", acrylate-styrene copolymer, manufactured by Mitsubishi Rayon Co., Ltd.) 40% toluene solution | 50 parts |
| Rose Bengal (2% methanol solution) | 10 parts |
| Toluene | 90 parts |

A water-resistant paper support for electrophotographic planography was coated with the Dispersion 1 by using a wire bar so as to give a dry coated amount of 25 g/m$^2$, and then was dried at 110° C. This sample was taken as Comparative Example 1. The samples similarly prepared were subjected to plasma treatment by using a plasma-treating machine at a degree of vacuum of $10^{-1}$ Torr, a frequency of 13.56 MHz, and an output of 10 W for 1, 3 and 5 minutes to prepare samples of Examples 1 and 2 and Comparative Example 2, respectively.

For the four samples of the original formes for electrophotographic planography thus obtained, the exposure ratio of zinc oxide on the surfaces of the photoconductive layers was determined by XPS.

Subsequently, planographic printing formes were prepared from the above-mentioned original formes using a prepress processing machine for electrophotography ("ELP-404V", manufactured by Fuji Photo Film Co., Ltd.), and the optimum exposure time was determined.

Background scumming and scratching were evaluated by printing the planographic printing formes obtained with an automatic printing machine ("611XLA-2", manufactured by Hamada Insatsuki K.K.). The background scumming was evaluated by a value obtained by subtracting the density of the paper support itself from the density of background scumming portions measured with a Macbeth densitometer. Scratching developed when the printing forme was transferred in the automatic printing machine was visually evaluated. The results are shown in Table 1.

TABLE 1

| | Plasma-treating time (min) | Exposure percentage of zinc oxide (%) | Optimum sensitivity (sec) | Background scumming density | Scratching* |
|---|---|---|---|---|---|
| Comparative Example 1 | 0 | 1.3 | 10.3 | 0.16 | A |
| Example 1 | 1 | 2.6 | 9.2 | 0.01 | A |
| Example 2 | 3 | 4.1 | 8.9 | 0.00 | A |
| Comparative Example 2 | 5 | 8.3 | 8.5 | 0.00 | B–C |

Note:
*A: No scratching developed.
B: Scratching was slightly observed on closer inspection.
C: Scratching was observed at a glance.

XPS measurement of was carried out under the following conditions:

Measuring Apparatus: "ESCA5400MC" manufactured by Perkin-Elmer Corporation

X-ray Source: Mg

Anode Output: 400 W

Excitation Voltage: 15 kV

Pass Energy: 71.55 eV eV/Step: 0.100 eV

Time/Step: 100 msec

Analyzed Area: 1.1 mm in diameter (Aperture: 3)

Integrating: once

Photoelectron Takeout Angle: 45°

Degree of Vacuum on Measuring: $1\times10^{-7}$ to $3\times10^{-7}$ Torr

Number of Measured Points: 3 points per sample

Zinc Photoelectron Spectral Intensity:determined by the peak area of Zn 2p3/2

The standard zinc photoelectron spectral intensity of zinc oxide was determined according to the following method: Tablets were prepared by molding a photoconductive zinc oxide power under pressure (520 kg/cm$^2$, 10 seconds) using a tablet molding machine for measuring infrared absorption spectra. Argon sputtering and ion etching were conducted for the tablets inside an XPS apparatus prior to measurement, and it was ascertained that peaks of C and other surface contaminants other than Zn and O were not detected, and that the atomic percent ratio of Zn to O was substantially equal. Thereafter, the measurement was conducted so quickly that contaminants could not adhere again.

EXAMPLES 3 AND 4 AND COMPARATIVE EXAMPLES 3 AND 4

The following starting materials were mixed and dispersed with a Kady mill at a rate of 4,000 rpm for 30 minutes to obtain Dispersion 2 for a photoconductive layer.

| Dispersion 2 | |
|---|---|
| Photoconductive Zinc Oxide ("Sazex 2000", manufactured by Sakai Kagaku) | 100 parts |
| Resin Binder ("LR360", acrylate-styrene copolymer, manufactured by Mitsubishi Rayon Co., Ltd.) 40% toluene solution | 30 parts |
| Resin Binder ("LR333", acrylate-styrene copolymer, manufactured by Mitsubishi Rayon Co., Ltd.) 40% toluene solution | 22 parts |
| Rose Bengal (2% methanol solution) | 10 parts |

-continued

| Dispersion 2 | |
|---|---|
| Toluene | 80 parts |

A water-resistant paper support for electrophotographic planography was coated with the Dispersion 2 so as to give a dry coated amount of 26 g/m$^2$, and then dried at 120° C. This sample was taken as Comparative Example 3. The samples similarly prepared were flame-treated on the surface with an acetylene gas burner. The treatment was conducted for 2, 5 and 10 seconds to prepare samples of Examples 3 and 4 and Comparative Example 4, respectively. These samples were evaluated in the same manner as in Example 1. The results are shown in Table 2.

TABLE 2

| | Flame-treating time (sec) | Exposure percentage of zinc oxide (%) | Optimum sensitivity (sec) | Background scumming density | Scratching* |
|---|---|---|---|---|---|
| Comparative | 0 | 1.4 | 18.7 | 0.13 | A |
| Example 3 | 2 | 2.6 | 17.5 | 0.02 | A |
| Example 4 | 5 | 3.7 | 16.1 | 0.01 | A |
| Comparative Example 4 | 10 | 12.8 | 13.1 | 0.00 | C |

Note:
*A: No scratching developed.
B: Scratching was slightly observed on closer inspection.
C: Scratching was observed at a glance.

The results of the above-mentioned Examples and Comparative Examples clearly show that when the exposure percentage of zinc oxide on the surfaces of the photoconductive layers is in the range of from 2.1 to 5%, the original forme for electrophotographic planography is significantly improved in background scumming, and also has satisfactory scratching resistance.

The original formes for electrophotographic planography of the present invention has high sensitivity, develops little background scumming even by a single cycle of desensitizing treatment, and also develops little scratching.

While the invention has been described in detail and with reference to specific examples thereof, it will be apparent to one skilled in the art that various changes and modifications can be made therein without departing from the spirit and scope thereof.

What is claimed is:

1. An original forme for electrophotographic planography comprising a paper support having thereon a photoconductive layer comprising a photoconductive material including at least zinc oxide and a resin binder, the exposure percentage of said zinc oxide on a surface of said photoconductive layer being in the range of from 2.1 to 5%, wherein said exposure percentage is determined by the following equation using zinc photoelectron spectra of X-ray photoelectron spectroscopy:

Exposing percentage of zinc oxide in % =

$$\frac{\text{Zinc photoelectron spectral intensity of photoconductive layer surface}}{\text{Zinc photoelectron spectral intensity of pure zinc oxide powder}} \times 100$$

2. An original forme for electrophotographic planography as claimed in claim 1, wherein the weight ratio of said photoconductive material to said resin binder in said photoconductive layer is in the range of from 85/15 to 82/18.

3. An original forme for electrophotographic planography as claimed in claim 1, wherein the exposure percentage of said zinc oxide on a surface of said photoconductive layer is in the range of from 2.2 to 4.5%.

* * * * *